US006918653B2

(12) United States Patent
Ahne et al.

(10) Patent No.: US 6,918,653 B2
(45) Date of Patent: Jul. 19, 2005

(54) MULTI-FLUID JETTING DEVICE

(75) Inventors: Adam J. Ahne, Lexington, KY (US); Frank E. Anderson, Sadieville, KY (US); John D. Zbrozek, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 39 days.

(21) Appl. No.: 10/443,165

(22) Filed: May 22, 2003

(65) Prior Publication Data

US 2004/0233248 A1 Nov. 25, 2004

(51) Int. Cl.[7] ..... B41J 2/145
(52) U.S. Cl. ..... 347/43
(58) Field of Search ..... 347/20, 40, 42, 347/44, 43, 47, 56, 68

(56) References Cited

U.S. PATENT DOCUMENTS

| | | | | |
|---|---|---|---|---|
| 4,017,869 A | | 4/1977 | Meyer et al. | |
| 4,610,151 A | | 9/1986 | Sandler | |
| 4,758,849 A | | 7/1988 | Piatt et al. | |
| 5,059,984 A | | 10/1991 | Moore et al. | |
| 5,257,043 A | | 10/1993 | Kneezel | |
| 5,387,440 A | | 2/1995 | Takemoto et al. | |
| 5,434,606 A | | 7/1995 | Hindagolla et al. | |
| 5,595,785 A | | 1/1997 | Hindagolla et al. | |
| 6,312,103 B1 | | 11/2001 | Haluzak | |
| 6,347,868 B1 | | 2/2002 | Headrick et al. | |
| 6,394,575 B1 | | 5/2002 | Kent | |
| 6,527,365 B1 | | 3/2003 | Silverbrook | |
| 6,746,107 B2 | * | 6/2004 | Giere et al. | 347/65 |
| 2003/0227515 A1 | * | 12/2003 | Scott | 347/47 |

FOREIGN PATENT DOCUMENTS

| | | | | |
|---|---|---|---|---|
| JP | 09-25433 | * | 9/1997 | B41J/2/045 |
| JP | 09254383 A | | 9/1997 | |
| JP | 11216882 | | 8/1999 | |

OTHER PUBLICATIONS

Color Balanced Ink Jet System, IBM Technical Disclosure Bulletin, p. 1313, Oct. 1, 1975.*

* cited by examiner

*Primary Examiner*—Huan Tran
(74) *Attorney, Agent, or Firm*—Luedeka, Neely & Graham, P.C.

(57) ABSTRACT

An improved multi-fluid jetting device. The jetting device includes a nozzle plate having a substantially planar surface for ejecting a fluid therefrom. The nozzle plate has at least 10 or more nozzles wherein groups of three adjacent nozzles are arranged in a triad orientation and wherein at least two adjacent nozzles in said triad orientation are coupled to two different fluid sources for fluid ejection from said adjacent nozzles substantially perpendicular to said nozzle plate surface.

16 Claims, 8 Drawing Sheets

MULTI-FLUID JETTING DEVICE

FIELD OF THE INVENTION

The invention relates to improved multi-fluid jetting devices for dispensing a variety of fluids, preferably for dispensing two or more different fluids for a variety of applications.

BACKGROUND OF THE INVENTION

Micro-miniature fluid jetting devices are suitable for a wide variety of applications including hand-held ink jet printers, ink jet highlighters, ink jet air brushes, miniature evaporative coolers, and delivery of controlled quantities of medicinal fluids and purified water to precise locations. One of the challenges facing the manufacture and use of such miniature jetting devices is providing a device that is capable of dispensing two or more fluids at a time to provide a desired result. Such a process is particularly useful for providing color images, however, the process is not limited to ink jet printing applications.

Another challenge facing the manufacture and use of such devices is the provision of a device capable of dispensing multiple fluids without significant separation distance or white space between the different fluids being dispensed. In a color printing application, the white space between the different color dots inhibits a visual perception that the different colors have been mixed to provide a desired or substantially uniform hue. Accordingly, there remains a need for improved fluid jetting devices for dispensing multiple fluids to provide reduced amount of white space between deposited dots of fluid.

SUMMARY OF THE INVENTION

With regard to the foregoing and other objects and advantages the invention provides an improved multi-fluid jetting device. The multi-fluid jetting device includes a nozzle plate having a substantially planar surface for ejecting a fluid therefrom. The nozzle plate has at least 10 or more nozzles wherein groups of three adjacent nozzles are arranged in a triad orientation and wherein at least two adjacent nozzles in said triad orientation are coupled to two different fluid sources for fluid ejection from said adjacent nozzles substantially perpendicular to said nozzle plate surface.

In another embodiment, the invention provides a nozzle for a miniature multi-fluid jetting device. The nozzle plate has a substantially planar surface and includes a plurality of 10 or more nozzles having groups of three adjacent nozzles arranged in a triad orientation wherein at least two adjacent nozzles in said group are coupled to two different fluid sources for fluid ejection substantially perpendicular to said nozzle plate surface.

Providing a multi-fluid jetting device with a nozzle plate having nozzles for jetting different fluids such as different color inks arranged in a triad or triangular orientation according to the invention provides several important advantages. For one, apparent mixing of different fluids to provide a desired result such as a desired color on a print media is simpler and requires less motion of the jetting device. Another advantage of the invention is that ink jet printers containing nozzle plates with such nozzle arrangements for jetting different color inks are less prone to dot placement variations which can produce print quality defects. Scanning type color ink jet printheads containing nozzle groups as described herein are effective to reduce shifts in the color table for left-to-right versus right-to-left motion of the printhead.

BRIEF DESCRIPTION OF THE DRAWINGS

Further advantages of the invention will become apparent by reference to the detailed description of preferred embodiments when considered in conjunction with the drawings, wherein like reference characters designate like or similar elements throughout the several drawings as follows.

DETAILED DESCRIPTION OF THE INVENTION

Figure 1:
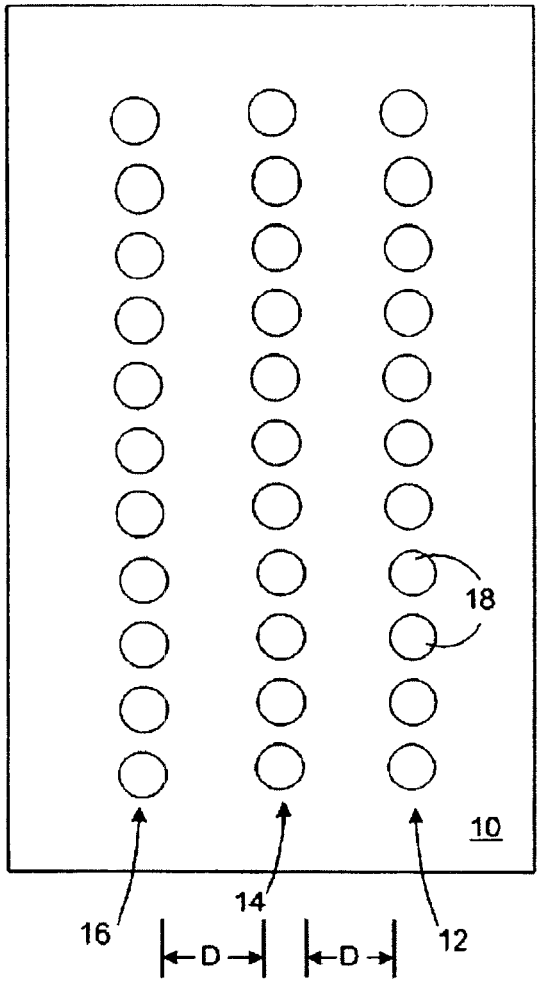
Fig. 1 Prior Art
FIG. 1 is a plan view, not to scale, of a prior art nozzle plate containing three spaced-apart columns of nozzles for jetting different fluids.

With reference to FIG. 1, a prior art multi-fluid nozzle plate 10 for a jetting device is shown. The nozzle plate 10 includes three columns 12, 14, and 16 containing a plurality of nozzles 18 in each column. Nozzle column 14 is displaced from nozzle columns 12 and 16 by distance D. Each column 12, 14, and 16 is dedicated to depositing a different color ink or different fluid on a print media. It will be appreciated that deposition of two or more dots of fluids other than inks is possible with such fluid jetting devices. However, for ease of describing the invention, the discussion will be focused on the deposition of ink.

Figure 2:
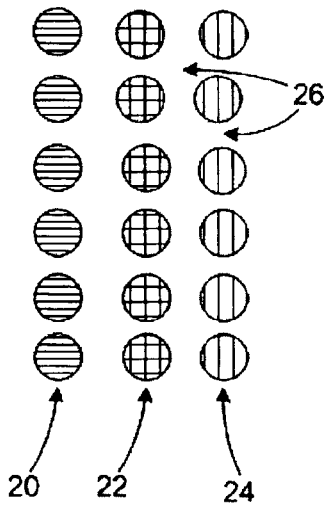
Fig. 2 Prior Art
FIG. 2 is a plan view, not to scale, of dot placement of different fluids on a media using a prior art nozzle plate.

In FIG. 2, ink dots 20 represent blue color dots, ink dots 22 represent yellow color dots, and ink dots 24 represent magenta color dots. Dots 20, 22, and 24 deposited from the nozzle plate 10 attached to a jetting device at substantially the same time will also have a significant amount of white space 26 between adjacent dots as deposited, for example, on the print media. Moving the jetting device during the deposition process may increase color mixing provided there is little or no variation in the speed or direction of motion of the jetting device during the deposition process.

Figure 3:
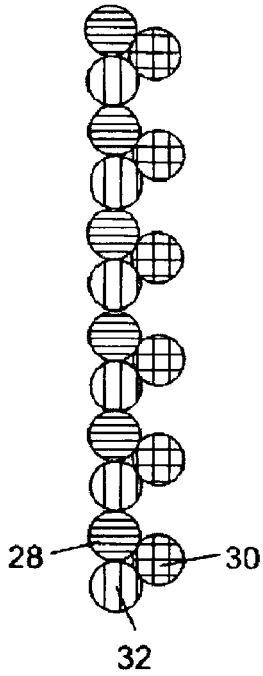
FIG. 3 is plan view, not to scale, of dot placement of different fluids on a media using a nozzle plate according to the invention.

Ideally, for good color mixing, different color ink dots 28, 30, and 32 should be closely adjacent one another on the print media as shown in FIG. 3 to reduce the amount of white space between the dots. If the dots 28, 30, and 32 are small enough, individual ink colors will appear as a single color on the print media. Multi-color dots as small as about 120 microns appear to a human eye to be a single color. Minimizing the white space 26 between the dots will thus sharpen the image and improve color saturation and hue properties of the deposited dots. While the dots 28, 30 and 32 are shown in FIG. 3 as touching one another, there may be a small amount of separation between the dots 28, 30, and 32, however this separation is substantially less than the separation between dots 20, 22, and 24 (FIG. 2). It is preferred that the white space 26 or separation between adjacent dots 28, 30, and 32 be less than about 1.1 times the dot diameter on the print media.

Figure 4:
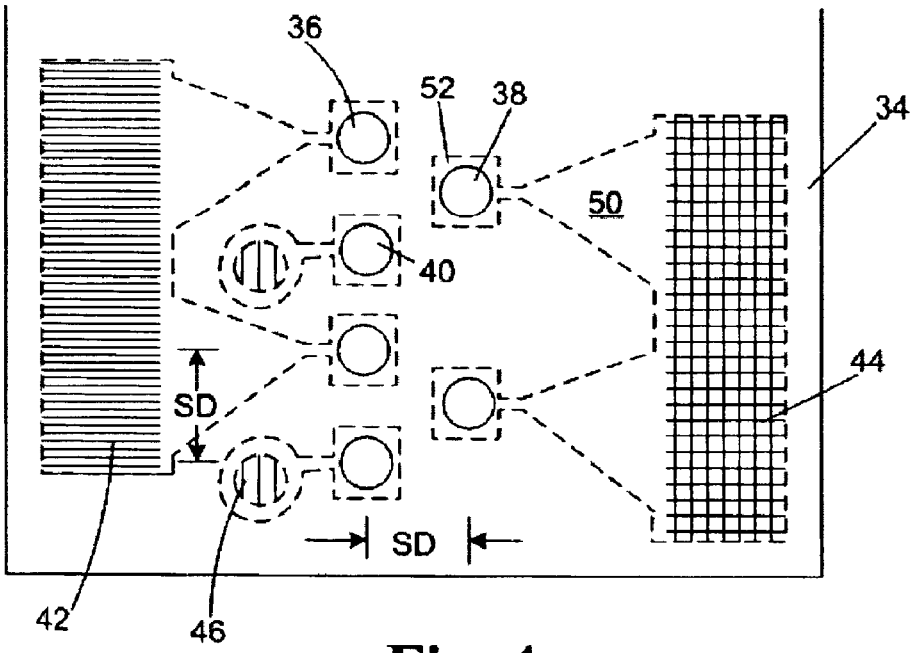
FIG. 4 is a top plan view, not to scale, of a nozzle plate according to a first aspect of the invention.
Figure 5:
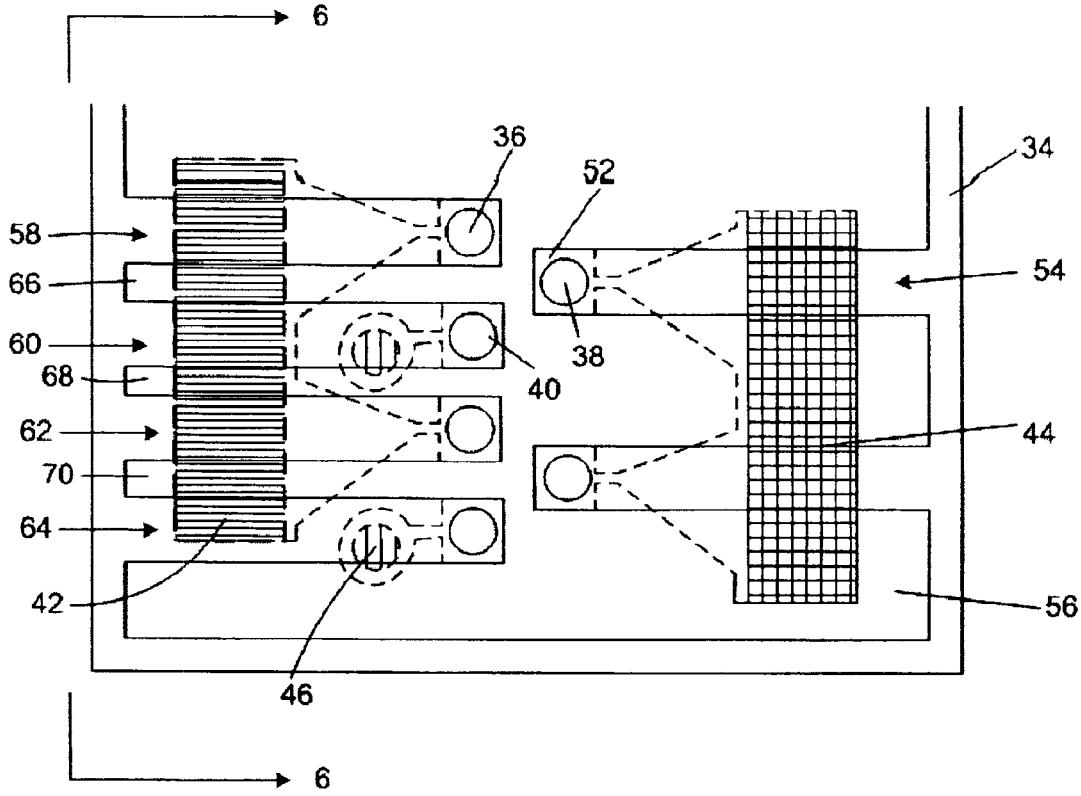
FIG. 5 is a top plan view, not to scale, of a nozzle plate according to the first aspect of the invention containing a barrier layer for separating different fluids from each other.
Figure 6:
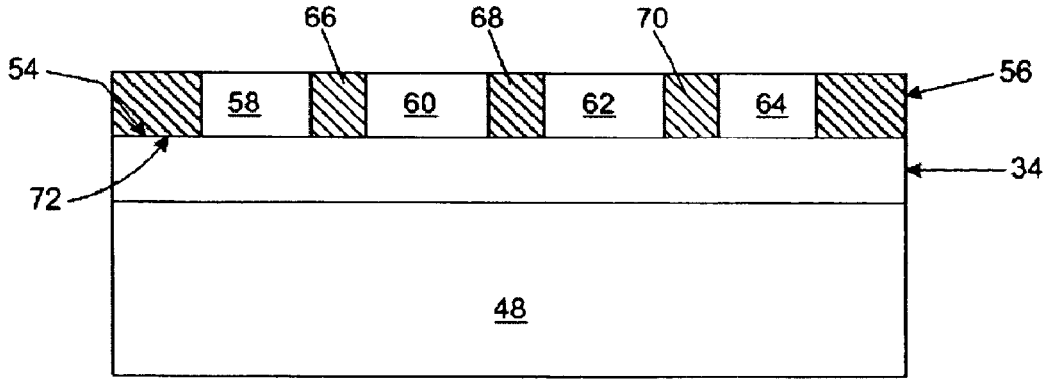
FIG. 6 is a side elevational view, not to scale, taken along lines 6—6 of FIG. 5.

It is evident that a nozzle plate, such as nozzle plate 10, having individual columns of nozzles is ineffective to produce closely adjacent dots 18, 30, and 32 as shown in FIG. 3. Accordingly, preferred multi-fluid nozzle plates are illustrated in FIGS. 4–6. FIG. 4 is a top plan view of a multi-fluid nozzle plate 34 according to a first embodiment of the invention. The nozzle plate 34 contains a triad or triangular arrangement of nozzles 36, 38, and 40 wherein adjacent nozzles are dedicated to different fluids, in this case, different color inks. For example, nozzle 36 is dedicated to depositing blue ink (C), nozzle 38 is dedicated to depositing yellow ink (Y), and nozzle 40 is dedicated to depositing magenta ink (M). The nozzles 36, 38, and 40 are preferably substantially equidistant from one another. The center to center separation distance SD between adjacent nozzles preferably ranges from about 0.8 times the dot size on the print media to about 1.7 times the dot size on the print media.

Ink is provided to the nozzles 36, 38, and 40 from separate ink supplies through separate fill slots 42, 44, and 46. The ink fill slots 42, 44, and 46 are preferably formed in a semiconductor substrate 48 (FIG. 6) attached to the nozzle plate 34. Ink flows through a supply channel 50 from ink fill slot 44 to an ink chamber 52 for flow through a nozzle, such as nozzle 38. The semiconductor substrate 48 preferably contains a fluid ejection device such as a heater resistor or piezoelectric device for causing ink or other fluids to flow out the ink chamber 52 through nozzle 38.

With most drop on demand ink jetting devices, ink occasionally drools out of the nozzle holes and forms a puddle on the nozzle plate when the ejection device is not in use. These puddles of ink should be occasionally wiped off of the nozzle plate so that formation of dried ink sufficient to affect nozzle performance will not occur. However, with the nozzle plate 34 having closely adjacent nozzles 36, 38 and 40 for depositing different colors of ink or different fluids, there is a possibility of ink colors mixing on the surface of the nozzle plate 34 when the nozzles 36, 38, and 40 drool. If a puddle on the nozzle plate 34 connects different color nozzles, a difference in back pressure for a color ink adjacent the puddle may occur. A difference in back pressure may cause ink to flow from one ink feed slot to another thereby cross-contaminating the ink supplies and ruining the jetting device.

In order to reduce mixing of different colors of inks on a surface 54 of a nozzle plate, a barrier system is provided by barrier layer 56 on the surface 54 of the nozzle plate 34 as shown in FIGS. 5 and 6. The barrier layer 56 is preferably provided by an ink resistant material such as a polyimide film available from DuPont High Performance Materials of Circleville, Ohio under the trade name KAPTON. The barrier layer 56 may be adhered to the surface 54 by a variety of means including adhesives, spin-coating and the like. Channels, such as channels 58, 60, 62, and 64 may be cut into the barrier layer 56 to form individual barrier fingers 66, 68, and 70 between adjacent nozzles to prevent color mixing and to direct puddles away from the nozzle holes.

Because the barrier layer 56 may make it difficult to clean the nozzle plate 34 adequately, it is preferred that the surface 54 of the nozzle plate be coated with a hydrophobic material to reduce wetting of the nozzle plate surface 54. Examples of hydrophobic coatings for nozzle plates include, but are not limited to, polytetrafluoroethylene, polyperfluoroalkoxybutadiene, polyfluorovinylidene, polyfluorovinyl, polydiperfluoroalkyl fumarate, as described in U.S. Pat. No. 5,387,440 to Takemoto et al., and a cross-linked silicone resin, such as the methyltrimethoxysilane manufactured by Dow Coming of Midland, Mich. under the trade name Z 6070 silane as described in U.S. Pat. No. 5,434,606 to Hindagolla et al.

Hydrophilic material may be used as a nozzle plate coating to induce ink to flow away from the nozzle holes. Such wetting materials include, but are not limited to, polyethylene terphthalate (PET), and polycarbonate as described in U.S. Pat. No. 5,434,606 to Hindagolla et al., and titanium dioxide as described in U.S. Pat. No. 6,312,103 to Haluzak.

Figure 7:
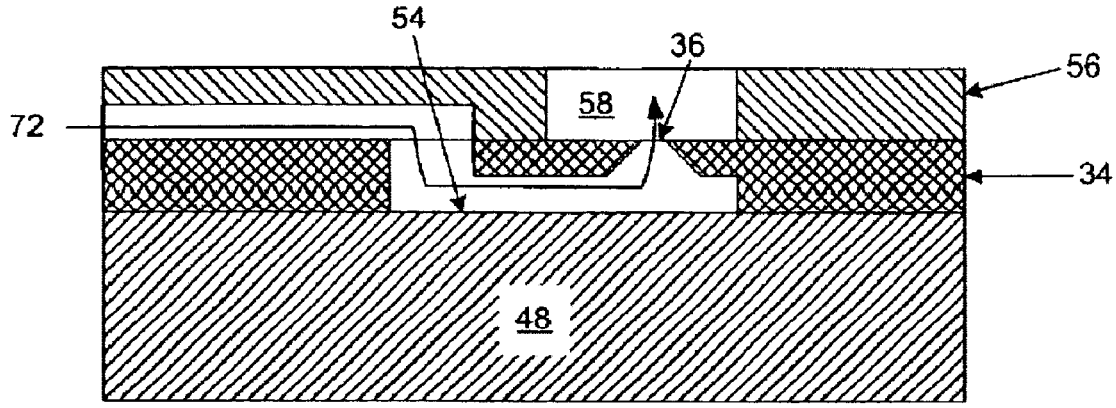
FIG. 7 is a cross-sectional end view, not to scale, through a barrier layer nozzle plate, and substrate according to one aspect of the invention.

The barrier layer 56 may also include additional flow channels for ink flow to the nozzles. Such flow channels 72 may be formed through a portion of the barrier layer 56 adjacent surface 54 of the nozzle plate 34 as shown by an end cross-sectional view of the nozzle plate 34, barrier layer 56, and substrate 48 in FIG. 7. Each of the flow channels 72 preferably connect to a fluid source such as provided by fill slot 42.

Another method for preventing the formation of puddles on the surface 54 of the nozzle plate 34, instead of or in addition to the use of the barrier layer 56, is to provide a solid flexible plug that can be pressed against the nozzle holes when the ejection device is capped. The plug would be sufficiently flexible to seal the nozzle holes thus preventing ink puddles from forming when the ejection device was not in use. It is preferred to apply the plug to the nozzle plate 34 after cleaning or wiping the surface 54 of the nozzle plate 34 to remove excess ink therefrom.

Figure 8:
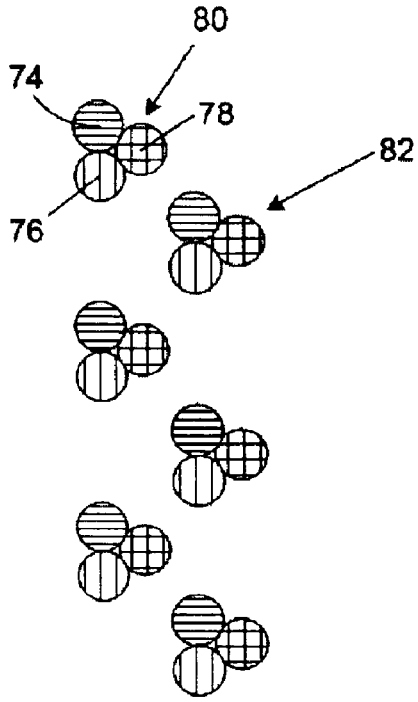
FIG. 8 is plan view, not to scale, of dot placement of different fluids on a media using a nozzle plate according to another embodiment of the invention.

In another embodiment, the nozzles in a nozzle plate for a jetting device may be arranged in a staggered array of triad nozzles to produce a staggered array of colored ink dots 74, 76, and 78 as shown in FIG. 8. In this case, the nozzle triad dots 80 are offset from adjacent nozzle triad dots 82 rather than being aligned in a single column as shown by ink dots 28, 30, and 32 in FIG. 3. In this embodiment, the nozzle contains nozzle holes in locations sufficient to produce the staggered array of colored ink dots 74, 76, and 78. In all other respects, the nozzle plate, nozzle holes, ink chambers, ink channels, and ink fill slots are similar to those described with respect to FIGS. 4–6. An advantage of such an arrangement of triad nozzles is that more space is provided on the substrate and in the nozzle plate for wiring and flow paths while maintaining a reduction in white space between the triad dots 80 and 82 as compared to colored dots in FIG. 2.

Figure 9:
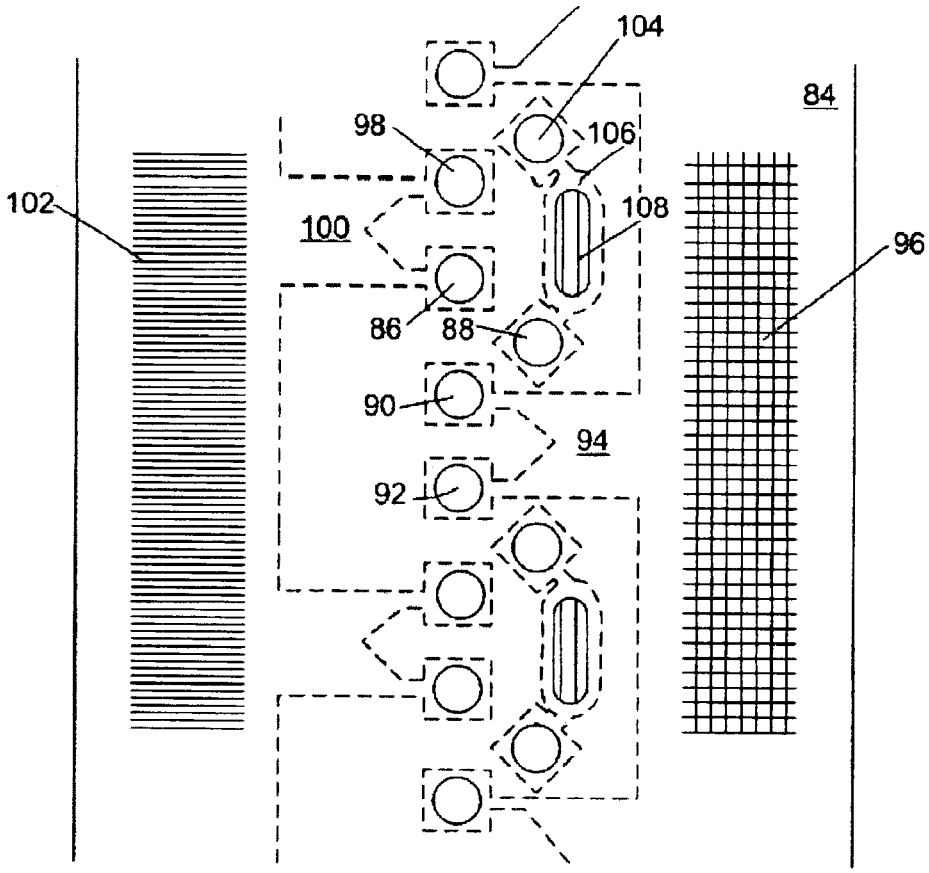
FIG. 9 is a top plan view, not to scale, of a nozzle plate according to a second aspect of the invention.

Another arrangement of triad nozzles is provided in FIGS. 9–12. In this arrangement, instead of repeating CMY CMY CMY triad nozzles, the repeating sequence of nozzles is CMY YMC CMY YMC so that adjacent nozzles can share ink fills slots and flow channels as shown in FIGS. 9–12. With reference to FIG. 9, a nozzle plate 84 is provided containing a triad arrangement of nozzles 86, 88, and 90. As before, each of the nozzles 86, 88, and 90 is preferably dedicated to a different color ink or different fluid. However, unlike the embodiment illustrated in FIGS. 4–6, adjacent nozzles such as nozzles 90 and 92 are dedicated to the same fluid or same color ink. In this case, nozzles 90 and 92 share a common ink flow channel 94 and a common ink fill slot 96. Likewise, nozzles 86 and 98 share a common ink flow channel 100 and ink fill slot 102, and nozzles 88 and 104 share a common ink flow channel 106 and ink fill slot 108.

Figure 11:
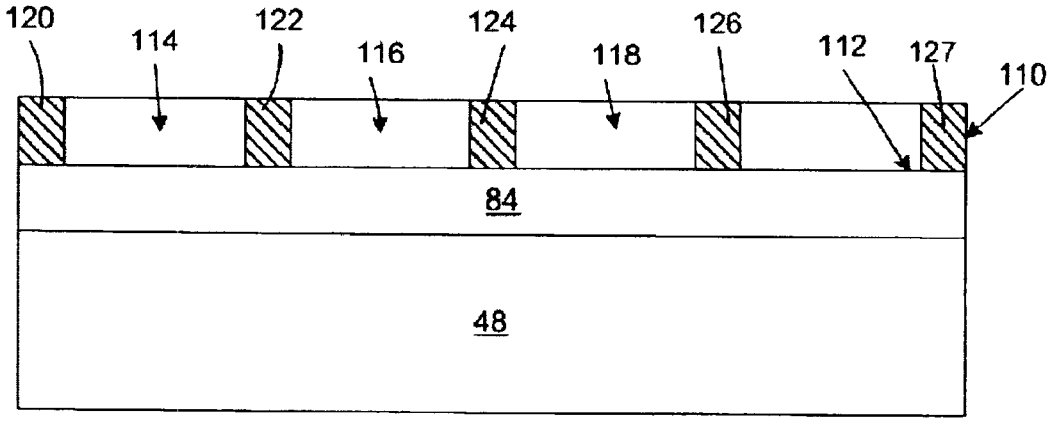
FIG. 11 is a side elevational view, not to scale, taken along lines 11—11 of FIG. 10.
Figure 10:
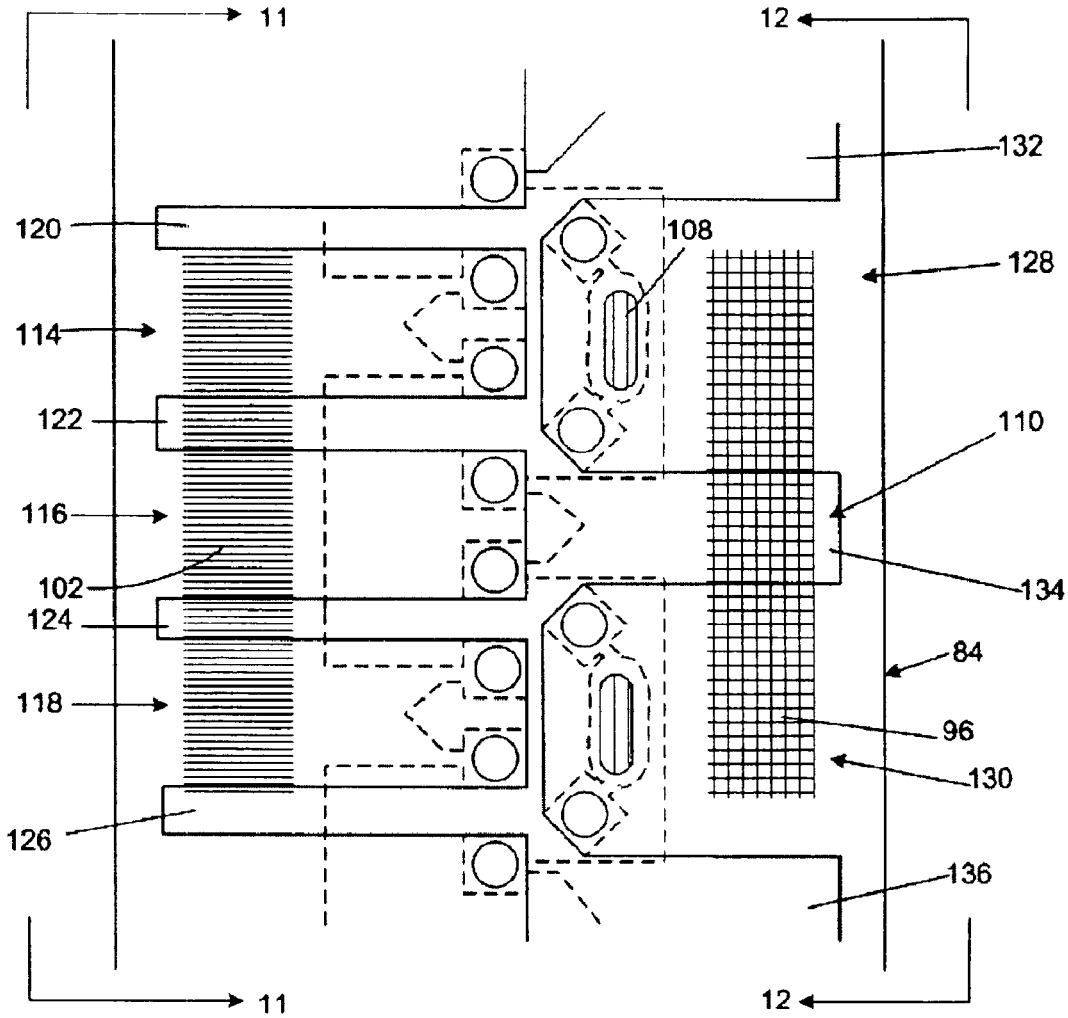
FIG. 10 is a top plan view, not to scale, of a nozzle plate according to the second aspect of the invention containing a barrier layer for separating different fluids from each other.
Figure 12:
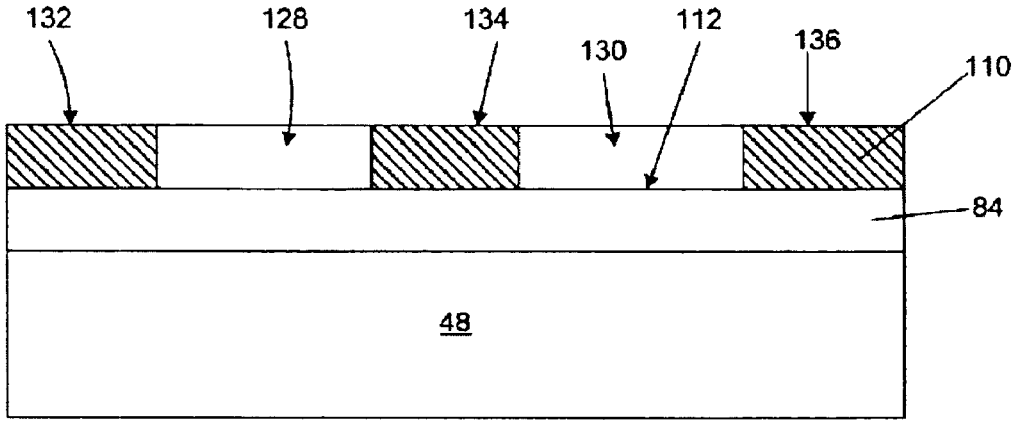
FIG. 12 is a side elevational view, not to scale, taken along lines 12—12 of FIG. 10.

An advantage of the repeating sequence of nozzles CMY YMC CMY YMC is that a simpler barrier layer 110 may be provided on a surface 112 of the nozzle plate as shown in FIGS. 10–12. As before, the barrier layer 110 provides channels 114, 116, and 118 and fingers 120, 122, 124, 126, and 127 (FIG. 11). Channels 128 and 130 and fingers 132, 134, and 136 are shown in FIG. 12 for an opposite side of the nozzle plate 84.

Figure 13:
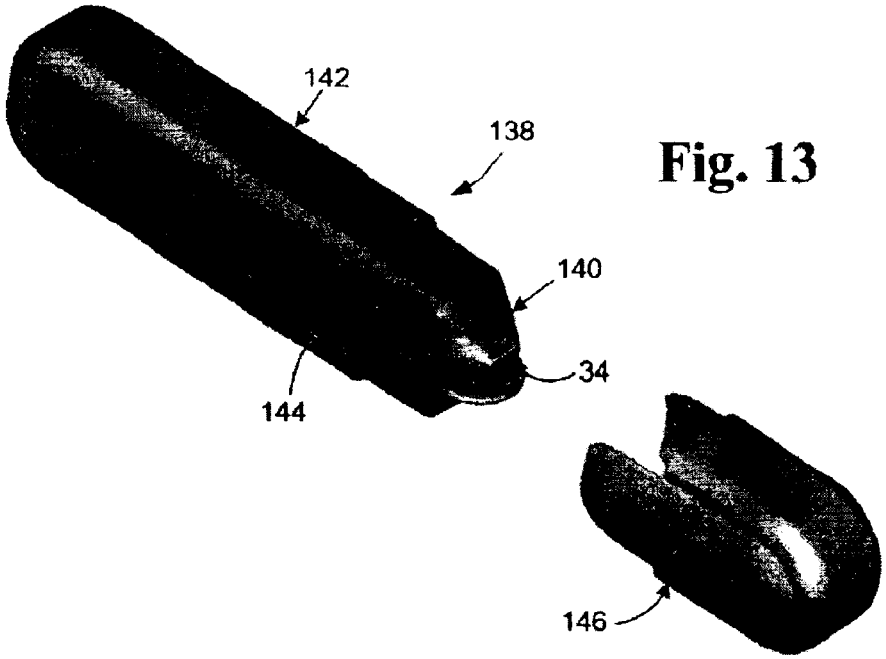
FIG. 13 is a perspective view, not to scale, of a handheld jetting device containing a nozzle plate according to the invention.

An ink jetting device 138 incorporating nozzle plate 34 or nozzle plate 84 according to the invention is illustrated for example in FIG. 13. The nozzle plate 34 is attached to a jet head portion 140 of the jetting device 138. An elongate body portion 142 to which the jet head portion 140 is attached preferably contains a power source such as a battery, logic devices for activating jetting devices on the jet head substrate, and a fluid reservoir. An activation switch 144 is preferably provided to activate the jetting devices. A cap or cover 146 is provided to seal the jet head portion 140 and nozzle plate 34 when the jetting device 138 is not being used.

Figure 14:
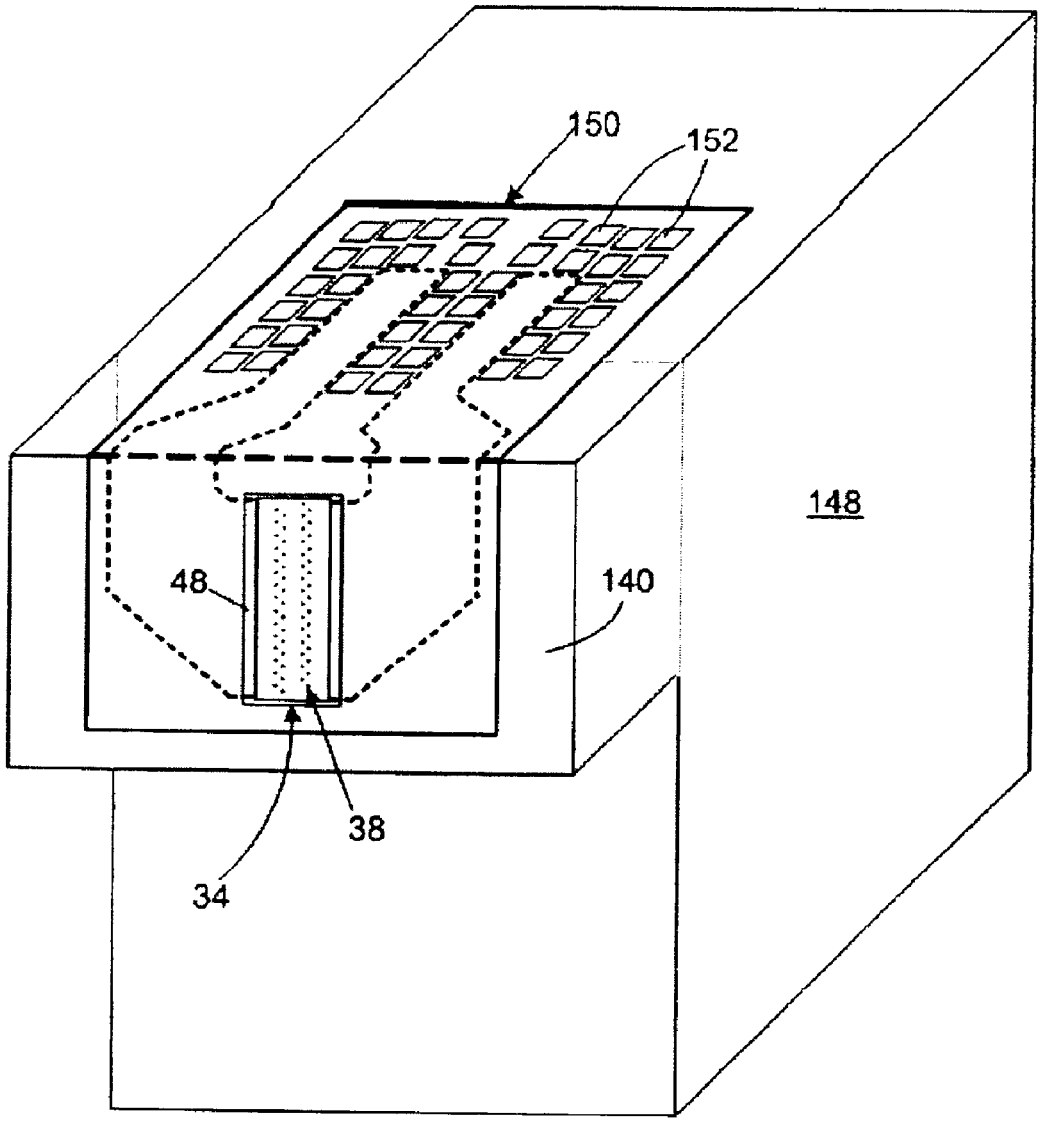
FIG. 14 is a perspective view, not to scale, of a fluid reservoir and jet head containing a nozzle plate according to the invention.

A typical fluid reservoir 148 for the jetting device 138 is illustrated for example in FIG. 14. The fluid reservoir 148 may be removably or permanently attached to the jet head portion 140 containing the nozzle plate 38. A tape automated bonding (TAB) circuit or flexible circuit 150 may be connected to the substrate 48 for activating ejection devices on the substrate 48. Electrical contact pads 152 are provided on the TAB circuit or flexible circuit 150 for providing power to the ejection devices.

Figure 15:
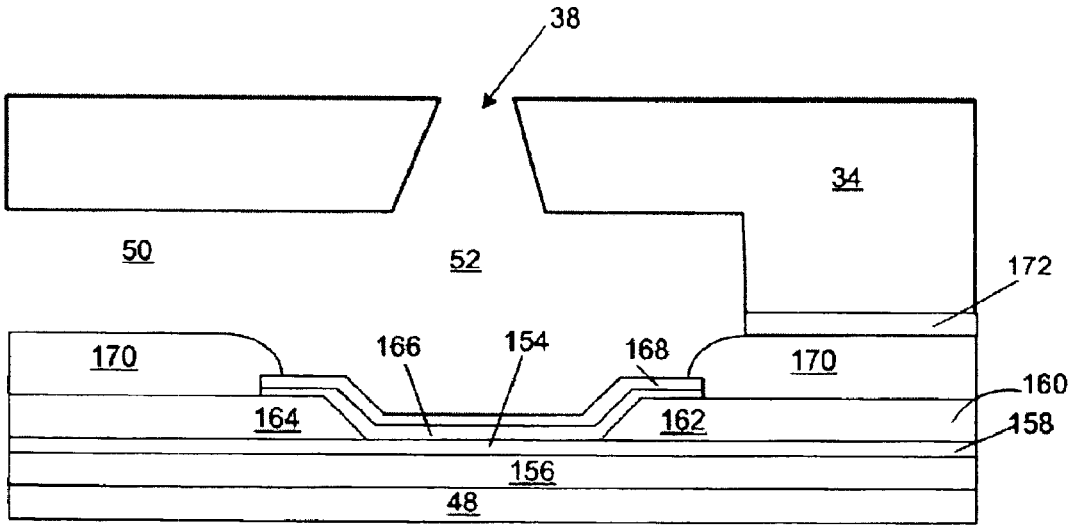
FIG. 15 is a cross-sectional view, not to scale, of components of a jetting device illustrating typical construction thereof.

A typical thermal type fluid jetting device 154 on a substrate 48 is illustrated for example in FIG. 15. The substrate 48 preferably provided by a silicon material containing a thermal barrier layer 156 and a resistive material layer 158. The resistive layer may be made from a variety of materials including but not limited to tantalum/aluminum alloys. A first metal conductive layer 160 such as aluminum, copper, or gold provides anode 162 and cathode 164 connections to the resistive layer 158. In order to protect the ejection device 154 from corrosion and erosion, a dual layer including a passivation layer 166 made of silicon nitride, silicon carbide, or a combination of silicon nitride and silicon carbide, and a cavitation layer 168 made of tantalum is preferably provided. A dielectric layer 170 is preferably provided over the first metal conductive layer 162 to insulate layer 162 from a second metal conductive layer 172. Like the first metal conductive layer 160, the second metal conductive layer 172 may be made of aluminum, copper, gold and the like. A nozzle plate, such as nozzle plate 34 described above is attached substrate 48 to provide ink chamber 52 for fluid to be ejected by ejection device 154.

With regard to operation of the jetting device 154, ejection device wiring may be simplified by connecting multiple ejection devices in parallel to a single drive transistor. Typically all of the ejection devices connected in parallel would be for jetting the same fluid or same color ink. The ejection devices may be activated in bursts so that a time between dot deposits is less than a time required to completely refill an ink chamber 52. Accordingly, the first dot deposit will be a full volume fluid and subsequent dot deposits will contain less than a full volume of fluid. The different volume fluid droplets will have different velocities and directions, thus encouraging mixing between different fluids or different color inks on the print media.

Another advantage of the invention is that a conventional ink jet printer rather than a hand held jetting device may be designed to use triad nozzle hole configurations as set forth above. There are several advantages resulting from the use of a triad nozzle arrangement for an ink jet printer. For example, as the printhead is swept across a print media by a printhead carrier, the carrier motion often introduces unwanted vibrations into the printhead. Traditional spacing between different color ink jet nozzles may cause the nozzles to fire at different phases of the carrier vibrations. The resulting errors in relative CMY dot placement can cause print quality defects. With the triad nozzle arrangement described above, all three colors can fire at the same phase of carrier vibration thus improving print quality.

Yet another advantage of the invention is that a printhead containing the triad nozzle arrangement is substantially unaffected by the direction of travel of the printhead across the print media because the CYM dots are fired at the same time and arrive on the print media at the same time. With traditional print heads, there is a shift in the color table for left-to-right versus right-to-left motion of the printhead across the print media due to the order in which the dots arrive on the print media.

Still another advantage of the invention is that motion of the printhead is not required to mix the colors or to provide dots that appear to be a different color. Accordingly, applications that do not require a mechanism to move the printhead across the print media may be used.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An improved multi-fluid jetting device comprising a nozzle plate for ejecting a fluid therefrom, the nozzle plate having at least 10 or more nozzles wherein groups of three adjacent nozzles are arranged in a triad orientation in a substantially planar surface area of the nozzle plate, wherein a center-to-center separation distance between adjacent nozzles in each of said groups of three adjacent nozzles ranges from about 0.8 to about 1.7 times a droplet size elected from said nozzles, and wherein at least two adjacent nozzles in said triad orientation are coupled to two different fluid sources for fluid ejection from said adjacent nozzles substantially perpendicular to said substantially planar nozzle plate surface area.

2. The multi-fluid jetting device of claim 1 wherein the groups of three adjacent nozzles are aligned in a generally linear array.

3. The multi-fluid jetting device of claim 1 wherein the groups of three adjacent nozzles are aligned in a generally staggered array.

4. The multi-fluid jetting device of claim 1 wherein each nozzle in the group of three adjacent nozzles is coupled to a different color ink source.

5. The multi-fluid jetting device of claim 1 further comprising a barrier layer on a surface of the nozzle plate, the barrier layer containing channels and fingers arranged for inhibiting mixing between different fluids ejected from the groups of three adjacent nozzles.

6. The multi-fluid jetting device of claim 5 wherein the barrier layer further comprises at least one fluid supply channel for supplying fluid from a fluid source to at least one nozzle.

7. The multi-fluid jetting device of claim 1 further comprising a subgroup including two adjacent nozzles, one from each two different groups of nozzles each having a triad orientation wherein, said two adjacent nozzles in said subgroup are coupled to the same fluid source.

8. The multi-fluid jetting device of claim 1 wherein the jetting device comprises a device selected from the group consisting of handheld medicinal jetting devices, handheld ink jetting divides, and ink jet printers.

9. A nozzle plate for a miniature multi-fluid jetting device, the nozzle plate comprising a plurality of 10 or more nozzles having groups of three adjacent nozzles arranged in a triad orientation in a substantially planar surface area of the nozzle plate, wherein a center-to-center separation distance between adjacent nozzles in each of said groups of three adjacent nozzles ranges from about 0.8 to about 1.7 times a droplet size elected from said nozzles, and wherein at least two adjacent nozzles in said group are coupled to two different fluid sources for fluid ejection substantially perpendicular to said substantially planar nozzle plate surface area.

10. The nozzle plate of claim 9 wherein the groups of three adjacent nozzles are aligned in a generally linear array.

11. The nozzle plate of claim 9 wherein the groups of three adjacent nozzles are aligned in a generally staggered array.

12. The nozzle plate of claim 9 wherein each nozzle in the group of three adjacent nozzles is coupled to a different color ink source.

13. The nozzle plate of claim 9 further comprising a barrier layer on a surface of the nozzle plate, the barrier layer containing channels and fingers arranged for inhibiting mixing between different fluids ejected from the groups of three adjacent nozzles.

14. The nozzle plate of claim 13 wherein the barrier layer further comprises at least one fluid supply channel for supplying fluid from a fluid source to at least one nozzle.

15. The nozzle plate of claim 9 further comprising a subgroup including two adjacent nozzles, one from each two different groups of nozzles each having a triad orientation, wherein said two adjacent nozzles in said subgroup are coupled to the same fluid source.

16. The nozzle plate of claim 9 wherein the multi-fluid jetting device comprises a device selected from the group consisting of handheld medicinal jetting devices, handheld ink jetting devices, and ink jet printers.

* * * * *